US008722576B2

(12) United States Patent
Hayakawa et al.

(10) Patent No.: US 8,722,576 B2
(45) Date of Patent: May 13, 2014

(54) THERMOSENSITIVE RECORDING LABEL

(75) Inventors: Junichi Hayakawa, Tokyo (JP); Hiroshi Kohama, Tokyo (JP); Akihito Ogino, Tokyo (JP); Yasuaki Matsumori, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 79 days.

(21) Appl. No.: 13/393,827

(22) PCT Filed: Sep. 1, 2010

(86) PCT No.: PCT/JP2010/064862

§ 371 (c)(1), (2), (4) Date: Apr. 30, 2012

(87) PCT Pub. No.: WO2011/027752

PCT Pub. Date: Mar. 10, 2011

(65) Prior Publication Data

US 2012/0208698 A1 Aug. 16, 2012

(30) Foreign Application Priority Data

Sep. 3, 2009 (JP) ..... 2009-203476

(51) Int. Cl.
*B41M 5/333* (2006.01)
*B41M 5/44* (2006.01)

(52) U.S. Cl.
USPC ..... 503/226; 503/216

(58) Field of Classification Search
CPC .... B41M 5/3333; B41M 5/3336; B41M 5/44; B41M 2205/38; B41M 2205/40
USPC ..... 503/216, 226
See application file for complete search history.

(56) References Cited

U.S. PATENT DOCUMENTS

2009/0169282 A1* 7/2009 Keeton ..... 400/120.01

FOREIGN PATENT DOCUMENTS

| | | |
|---|---|---|
| JP | 53-091995 | 8/1978 |
| JP | 1-130972 | 5/1989 |
| JP | H07-149713 | 6/1995 |
| JP | H07-223374 | 8/1995 |
| JP | H08-059603 | 3/1996 |
| JP | H08-230324 | 9/1996 |
| JP | H09-164763 | 6/1997 |
| JP | H10-258577 | 9/1998 |
| JP | 2001-092358 | 4/2001 |
| JP | 2002-301873 | 10/2002 |
| JP | 2005-335295 | 12/2005 |
| JP | 2005-343907 | 12/2005 |
| JP | 2007-245362 | 9/2007 |
| JP | 2008-194912 | 8/2008 |
| JP | 2009-137220 | 6/2009 |
| WO | WO93/06074 | 4/1993 |
| WO | WO95/33714 | 12/1995 |
| WO | WO02/081229 | 10/2002 |
| WO | WO2011/027752 | 3/2011 |

OTHER PUBLICATIONS

International Search Report corresponding to International Patent Application No. PCT/JP2010/064862 dated Sep. 28, 2010.

Notification of Transmittal of Translation of the International Preliminary Report on Patentability (Chapter I or Chapter II of the Patent Cooperation Treaty) corresponding to International Patent Application No. PCT/JP2010/064862 dated Mar. 29, 2012.

Japanese Industrial Standard JIS Z 0237 "Testing methods of pressure-sensitive adhesive tapes and sheets," Japanese Standards Association (38 pages) (2009).

Supplementary European Search Report corresponding to European Patent Application No. 10813701.9-1701 / 2474963 dated Feb. 12, 2013.

* cited by examiner

*Primary Examiner* — Bruce H Hess

(74) *Attorney, Agent, or Firm* — Jenkins, Wilson, Taylor & Hunt, P.A.

(57) ABSTRACT

A thermosensitive recording label is provided having a thermosensitive recording layer and a tackifier layer installed sequentially on a transparent film substrate. The thermosensitive recording label has excellent water and weather resistance.

9 Claims, No Drawings

THERMOSENSITIVE RECORDING LABEL

FIELD OF THE INVENTION

The present invention relates to a thermosensitive recording label having a printable thermosensitive recording layer and a tackifier layer and more specifically to a thermosensitive recording label with excellent water resistance.

BACKGROUND OF THE INVENTION

A thermosensitive recording medium containing a thermosensitive recording layer, the major component of which are a colorless or pale colored electron donating leuco dye (henceforth referred to as "dye") and an electron accepting color developing agent (henceforth referred to as "color developing agent") that develops color when heated with the dye have found broad based practical applications. A thermal printer with an internally installed thermal head is ordinarily used to record on the thermosensitive recording medium. The thermosensitive recording mode is less noisy when recording, does not require a developing/fixing agent and is maintenance free, the device is relatively inexpensive and compact, and the color developed is very bright. Therefore, the thermosensitive recording mode is used in a broad range of applications such as facsimile devices, computer terminal printers, automatic ticket vending machines, meter recorders, handy terminals used outdoors and the like.

On the other hand, tacky labels having a tackifier layer on one side of paper are used extensively in labels such as price tag labels, merchandise labels, meter display labels, advertising labels and the like.

Furthermore, a thermosensitive recording label that combines a thermosensitive recording medium and a tacky label is ordinarily constructed by installing a tackifier layer containing a tackifier as a major component on the surface opposite to the thermosensitive recording layer. A thermosensitive recording label that uses a hot melt tackifier as the tackifier (Reference 1), a thermosensitive recording label that uses a heat activated tackifier containing a thermoplastic resin and a solid plasticizer as the tackifier (Reference 2), a thermosensitive recording label obtained by installing a intermediate layer between the substrate paper and the heat activated tackifier layer and using a hollow plastic pigment as a major component in the intermediate layer in order to improve the thermal efficiency of the heat activated tackifier during heating (Reference 3) and the like have been disclosed.

Such thermosensitive recording labels are used frequently under harsh conditions in applications such as frozen food labels, warning labels and logistics labels posted outside in extremely hot weather and the like in recent years, and the demand for water and weather resistance is increasing.

Therefore, the water and weather resistance of a thermosensitive recording label is ordinarily improved by installing a protective layer on the thermosensitive recording layer. (Reference 4 to 6)

REFERENCES

Reference 1: Japanese Patent Application Public Disclosure No. 2001-92358

Reference 2: Japanese Patent Application Public Disclosure No. 2005-343907

Reference 3: Japanese Patent Application Public Disclosure No. H07-223374

Reference 4: Japanese Patent Application Public Disclosure No. H08-230324

Reference 5: Japanese Patent Application Public Disclosure No. H09-164763

Reference 6: Japanese Patent Application Public Disclosure No. 2005-335295

PROBLEMS TO BE SOLVED BY THE INVENTION

However, conventionally constructed thermosensitive recording labels prepared by installing a thermosensitive recording layer on one side of a support material and a tackifier layer on the other side were found to be clearly limited when meeting the demand for improved water and weather resistance.

Therefore, the objective of the present invention is to present a thermosensitive recording label having much better water and weather resistance than conventionally available one.

MEANS TO SOLVE THE PROBLEMS

The inventors conducted intensive studies to achieve the objective. As a result, the inventors discovered that excellent water and weather resistance could be achieved by using a novel construction in which a thermosensitive recording layer and a tackifier layer are installed on a transparent film support material in this order since the outermost layer is a transparent film.

Furthermore, it is deemed that the construction may have a potential for the color development sensitivity, thermosensitive recording layer film strength and the like to be adversely affected since the thermosensitive recording layer and the tackifier layer are in contact with each other, and the tackifier layer components could invade the thermosensitive recording layer. However, the inventors discovered that the problems could be improved by selecting as the tackifier in the tackifier layer a tackifier that is not tacky at ambient temperature or particularly by selecting a tackifier that develops tackiness when heated to a temperature between 40° C. and 100° C.

That is, the present invention is a thermosensitive recording label having a thermosensitive recording layer comprising a colorless or pale colored electron donating leuco dye and an electron accepting color developing agent on a transparent film substrate and a tackifier layer containing a tackifier as a major component on the thermosensitive recording layer.

The tackifier is preferably not tacky at ambient temperature and is particularly a type that develops tackiness when heated to a temperature between 40° C. and 100° C.

ADVANTAGES OF THE INVENTION

The thermosensitive recording label of the present invention is constructed in the order of a transparent film, a thermosensitive recording layer, a tackifier layer and an adherend when the label is affixed on the adherend, therefore the water resistance of the image section is good and the thermosensitive recording layer is not easily influenced by the oxygen in air and the like. Therefore, the image section is stable (good light resistance and the like).

The thermosensitive recording label of the present invention offers an extremely good practical value since it can be used in warning labels and logistics labels, which are usually posted outdoors, and the like.

DETAILED DESCRIPTION OF THE INVENTION

A thermosensitive recording label of the present invention has the construction that comprises a thermosensitive recording layer containing a colorless or pale colored electron donating leuco dye and an electron accepting color developing agent installed on one surface of a transparent film substrate and a tackifier layer containing a tackifier as a major component installed on the thermosensitive recording layer. In addition, an intermediate layer may also be installed between the thermosensitive recording layer and the tackifier layer.

The transparent film used in the present invention is a polymeric material that is molded into a thin film. As far as the degree of transparency is concerned, a transparency that at least allows the printed letters and patterns to be seen by the naked eye from the other side of the film when the thermosensitive recording layer on one side of the film is printed is acceptable. The total light transmittance of the transparent film is preferably at least 60%, more preferably at least 70% and most preferably at least 90%. The transparent film may also be colored. The thickness of the transparent film is preferably from 20 μm to 100 μm.

As such a film, ionomer film (IO), polyethylene film (PE), poly(vinyl chloride) film (PVC), poly(vinylidene chloride) film (PVDC), poly(vinyl alcohol) film (PVA), polypropylene film (PP), polyester film, poly(ethylene terephthalate) film (PET), poly(ethylene naphthalate) film (PEN), polycarbonate film (PC), polystyrene film (PS), polyacrylonitrile film (PAN), ethylene-vinyl acetate copolymer film (EVA), ethylene-vinyl alcohol copolymer film (EMAA), nylon film (NY), polyamide film (PA), triacetyl cellulose film (TAC), norbornane film (NB), Arton film and the like, for example, may be listed as examples. Of these, PET, PEN, TAC, NB and Arton film are preferred due to their transparency, rigidity when processed into a label and the like. PET and PEN are particularly preferred due to their minimal surface undulation derived from the manufacturing process. Furthermore, the installation of a readily adhering layer by applying a polyester resin or silicone resin and the like to the film surface and the improvement in the adhesion of the coating layer through a corona treatment of the film surface are desirable.

As the PET film, Toyobo Ester (R) film E5107, E5100, E5101, Cosmo Shine (R) A4100, A 4300, A8300 and the like from Toyo Boseki K.K. may be cited. As the PEN film, Teonex (R) Q51, Q51DW, Q65F, Q65FA and the like from Teijin DuPont Film K.K. may be cited.

The transparent films may also contain various additives such as UV absorption agents, oxidation inhibitors, flame retarding agents, thermal stabilizers, color developing agents, mold releasing agents, softening materials, electrostatic inhibitors and the like.

As the tackifier used in the present invention, (i) tackifiers that are tacky at ambient temperature, such as rubber type tackifiers, acrylic tackifiers, silicone type tackifiers, urethane type tackifiers and the like, (ii) hot melt tackifiers that are not sticky at room temperature but that can be activated by heating and fusion to impart tackiness when used and (iii) heat activated tackifiers containing a thermoplastic resin and a solid plasticizer as major components may be listed as examples, but the tackifier is not limited to these examples.

When a tackifier that is tacky at ambient temperature is used, the thermosensitive recording label is constructed from a film support material, a thermosensitive recording layer, a tackifier layer, and a separating paper (release paper). A very high energy is needed to realize sufficient color development since printing must occur through a highly insulating film or paper. Therefore, the tackifier is preferably not tacky at ambient temperature.

In addition, when a hot melt tackifier is used, the thermosensitive recording label may be constructed from a film support material, thermosensitive recording layer and a tackifier layer and good color development can be achieved since energy is applied from the tackifier layer side. However, the tackiness development temperatures of hot melt tackifiers are ordinarily as high as from 100° C. to 180° C., then a sufficient tackiness may not be achieved at the optimum energy level for color development. On the other hand, the entire thermosensitive recording layer could develop color when energy capable of achieving sufficient tackiness is applied.

Therefore, the tackifier used in the present invention is preferably not tacky at ambient temperature, and heat activated tackifiers that develop tackiness when heated to a temperature between 45° C. and 100° C. or preferably between 50° C. and 90° C. are preferred.

As the heating method to achieve tackiness, the entire thermosensitive recording label may be heated by using a heating furnace or hot air and the like. However, the tackifier layer may also be heated partially by using a heating head for a short time. The latter case is preferred since the thermosensitive recording layer is not heated.

A thermosensitive recording layer can ordinarily develop color and cause a so-called "background coloring" when heated to 90° C. for at least about five minutes making this option undesirable.

Therefore, the color development problem resulting from heating to achieve tackiness in a heat activated tackifier can be avoided by using a type of heat activated tackifier with a tackiness development temperature in the temperature range described above.

"Not tacky at ambient temperature" refers to the degree of tackiness that allows a dry finger to feel no tackiness when touching a tacky surface at ambient temperature, which corresponds to, for example, a tackiness (ball tack) of less than 2 when tackiness is determined using JIS-Z-0237.

"Develop tackiness" refers to the degree of tackiness that a dry finger feels tackiness when touching a tacky surface, which corresponds to, for example, a ball tack of at least 2 when tackiness is determined using JIS-Z-0237.

The heat activated tackifier comprises a thermoplastic resin and a solid plasticizer as major components and preferably contains a tackiness imparting agent. The heat activation temperature of the heat activated tackifier can be adjusted appropriately, and a quality that allows both tackiness and color development to occur can be obtained.

As the thermoplastic resin used in a heat activated tackifier, polymers of vinyl aromatic compounds such as methyl methacrylate (105° C.), ethyl acrylate (−22° C.), butyl acrylate (−54° C.), 2-ethylhexyl acrylate (−85° C.), carboxy polycaprolacton acrylate (−41° C.), succinic acid monohydroxyethyl acrylate (−40° C.), styrene (100° C.) and the like; vinyl halides such as vinyl chloride (80° C.), vinylidene chloride (−20° C.) and the like; vinyl esters such as vinyl acetate (30° C.), vinyl propionate (10° C.) and the like; olefinic monomers such as ethylene (−125° C.), butadiene (−109° C.) and the like; and others such as acrylonitrile (130° C.) and the like may be cited. The numbers inside parentheses indicate glass transition temperature.

As the solid plasticizer used in a heat activated tackifier, for example, benzoic acid ester compounds, hindered phenol ester compounds and the like are preferably used. As the benzoic acid ester compound, for example, sucrose benzoate, diethylene glycol benzoate esters, benzoic acid glycerides, pentaerythritol benzoate esters, trimethylolethane benzoate esters, trimethyl propane benzoate esters and the like may be cited. However, trimethylolpropane benzoate ester is particularly preferred.

Other preferred solid plasticizers include hindered phenol ester compounds. For example, triethylene glycol bis[3-(3-t-butyl-4-hydroxyphenyl)propionate], triethylene glycol bis[3-(3-t-butyl-4-hydroxy-5-methylphenyl)propionate], triethylene glycol bis[3-(3,5-di-t-butyl-4-hydroxyphenyl)propionate], 1,6-hexane diol bis[3-(3-t-butyl-4-hydroxyphenyl)propionate], 1,6-hexane diol bis[3-(3-t-butyl-4-hydroxy-5-methylphenyl)propionate], 1,6-hexane diol bis[3-(3,5-di-t-butyl-4-hydroxyphenyl)propionate], thio bis[ethylene 3-(3-t-butyl-4-hydroxyphenyl)propionate], thio bis[ethylene 3-(3-t-butyl-4-hydroxy-5-methylphenyl)propionate] and thio bis[ethylene 3-(3,5-di-t-butyl-4-hydroxyphenyl)propionate] may be cited. As particularly preferred solid plasticizers, triethylene glycol bis[3-(3-t-butyl-4-hydroxy-5-methylphenyl)propionate], 1,6-hexanediol bis[3-(3,5-di-t-butyl-4-hydroxyphenyl)propionate] and thio bis[ethylene 3-(3,5-di-t-butyl-4-hydroxyphenyl)propionate] may be cited.

The solid plasticizers may also be used as mixtures of at least two of them. The aqueous dispersion of a solid plasticizer needs to maintain the dispersed particle size at less than a set size to prevent settling and maintain smoothness on the coated material. Therefore, solid plasticizers are ground and dispersed using a ball mill, handy mill and the like when necessary.

As the tackiness imparting agent used in a heat activated tackifier, for example, rosin type resins such as rosin, hydrogenated rosin and its derivatives, resin acid dimer and the like; terpene type resins such as terpene resins, aromatic modified terpene resins, hydrated terpene resins, terpene-phenol resins and the like; aliphatic petroleum resins, aromatic petroleum resins, alicyclic petroleum resins, styrene type resins, phenol resins and the like may be cited. The resins may be used individually or as mixtures of at least two.

A heat activated tackifier composition preferably contains the thermoplastic resin described above, an aqueous dispersion of a solid plasticizer and an aqueous dispersion of a tackiness imparting agent such as rosin ester and the like. The weight ratio of the solid fractions of the thermoplastic resin: an aqueous dispersion of a solid plasticizer:an aqueous dispersion of a tackiness imparting agent is preferably 20 to 40:50 to 70:10 to 20.

As specific examples of such heat activated tackiness agents, Heat Magic DW1040W (heat activation temperature 50° C. manufactured by Toyo Ink Co., Inc.); Ecobrid 5610 (heat activation temperature 70° C.), Ecobrid TM-1 (heat activation temperature 100° C.), Ecobrid S-1 (heat activation temperature 90° C.), Ecobrid TM-100 (heat activation temperature 70° C.), Ecobrid 5635 (heat activation temperature 70° C.), and Ecobrid 5640 (heat activation temperature 70° C.) (all manufactured by Daicel Fine Chem. Ltd.); Dicseal DLA-820K (heat activation temperature 80° C.) and Dicseal ED-920K (heat activation temperature 90° C.) (both manufactured by DIC Corporation) and the like may be cited. The heat activation temperatures inside the parentheses refer to the minimum temperature at which tackiness was developed after a composition was left standing for two minutes in a forced air dryer that was maintained at a constant temperature.

The adhesive layer may further contain surfactants, defoamers, lubricants, colorants, and fillers, if desired, in a range that does not interfere with the desired effects to achieve the objective described above.

The coating amount of the adhesive layer of the present invention after drying is preferably is 3~25 g/m$^2$, more preferably 5~18 g/m$^2$. When the coating amount of the adhesive layer is too less, the adhesion to the substrate becomes insufficient. When the coating amount of the adhesive layer is too much, a smooth coating surface cannot be obtained and drying property becomes reduced.

The thermosensitive recording layer of the present invention contains a dye and a color developing agent and may optionally further contain sensitizers, binders, crosslinking agents, stabilizers, pigments, slipping agents and the like.

Although the dye is not particularly restricted, and those commonly known in the technical area of a thermosensitive recording medium can be used, the dyes, such as triphenylmethane type compounds, fluorane type compounds, fluorene type compounds, divinyl type compounds and the like are preferred. Specific examples of the typical colorless to pale colored basic colorless dye are shown below. In addition, these basic colorless dyes may be used individually or also in mixtures of at least two of them.

<Triphenylmethane Type Leuco Dyes>

3,3-bis(p-dimethyl aminophenyl)-6-dimethylaminophthalide [alternate name: crystal violet lactone] and 3,3-bis(p-dimethyl aminophenyl)phthalide [alternate name: malachite green lactone]

<Fluorane Type Leuco Dyes>

3-Diethylamino-6-methylfluorane, 3-diethylamino-6-methyl-7-anilinofluorane, 3-diethylamino-6-methyl-7-(o,p-dimethylanilino)fluorane, 3-diethylamino-6-methyl-7-chlorofluoran, 3-diethylamino-6-methyl-7-(m-trifluoromethylanilino) fluorane, 3-diethylamino-6-methyl-7-(o-chloroanilino) fluorane, 3-diethylamino-6-methyl-7-(p-chloroanilino) fluorane, 3-diethylamino-6-methyl-7-(o-fluoroanilino) fluorane, 3-diethylamino-6-methyl-7-(m-methylanilino) fluorane, 3-diethylamino-6-methyl-7-n-octylanilino fluorane, 3-diethylamino-6-methyl-7-n-octylamino fluorane, 3-diethylamino-6-methyl-7-benzylamino fluorane, 3-diethylamino-6-methyl-7-dibenzylamino fluorane 3-diethylamino-6-chloro-7-methyl fluorane, 3-diethylamino-6-chloro-7-anilino fluorane, 3-diethylamino-6-chloro-7-p-methylanilino fluorane, 3-diethylamino-6-ethoxyethyl-7-anilino fluorane, 3-diethylamino-7-methyl fluorane, 3-diethylamino-7-chloro fluorane, 3-diethylamino-7-(m-trifluoromethylanilino) fluorane, 3-diethylamino-7-(o-chloroanilino) fluorane, 3-diethylamino-7-(p-chloroanilino) fluorane, 3-diethylamino-7-(o-fluoroanilino) fluorane, 3-diethylamino-benz[a]fluorine; 3-diethylamino-benz[c]fluorane, 3-dibutylamino-6-methylfluorane, 3-dibutylamino-6-methyl-7-anilino fluorane, 3-dibutylamino-6-methyl-7-(o,p-dimethylanilino) fluorane, 3-(dibutylamino-7-(o-chloroanilino) fluorane, 3-butylamino-6-methyl-7-(p-chloroanilino) fluorane, 3-dibutylamino-6-methyl-7-(o-fluoroanilino) fluorane, 3-dibutylamino-6-methyl-7-(m-fluoroanilino) fluorane, 3-dibutylamino-6-methylchloro fluorane, 3-dibutylamino-6-ethoxyethyl-7-anilino fluorane, 3-dibutylamino-6-chloro-7-anilino fluorane, 3-dibutylamino-6-methyl-7-p-methylanilino fluorane, 3-dibutylamino-7-(o-chloroanilino) fluorane, 3-dibutylamino-7-(o-fluoroanilino) fluorane, 3-di-n-pentylamino-6-methyl-7-anilino fluorane, 3-di-n-pentylamino-6-methyl-7-(p-chloroanilino) fluorane, 3-di-n-pentylamino-7-(m-trifluoromethylanilino) fluorane, 3-di-n-pentylamino-6-chloro-7-anilino fluorane, 3-di-n-pentylamino-7-(p-chloroanilino) fluorane, 3-pyrrolidino-6-methyl-7-anilino fluorane, 3-piperidino-6-methyl-7-anilino fluorane, 3-(N-methyl-N-propylamino)-6-methyl-7-anilino fluorane, 3-(N-methyl-N-cyclohexylamino)-6-methyl-7-anilino fluorane, 3-(N-ethyl-N-cyclohexylamino)-6-methyl-7-anilino fluorane, 3-(N-ethyl-N-xylylamino)-6-methyl-7-(p-chloroanilino) fluorane, 3-(N-ethyl-p-toluidino)-6-methyl-7-anilino fluorane, 3-(N-ethyl-N-isoamylamino)-6-methyl-7-anilinofluorane, 3-(N-ethyl-N-isoamylamino)-6-chloro-7-anilino fluorane, 3-(N-ethyl-N-tetrahydrofurfurylamino)-6-methyl-7-anilino fluorane, 3-(N-ethyl-N-isobutylamino)-6-methyl-7-anilino fluorane, 3-(N-ethyl-N-ethoxypropylamino)-6-methyl-7-anilino fluorane, 3-cyclohexylamino-6-chloro fluorane, 2-(4-oxahexyl)-3-dimethylamino-6-methyl-7-anilino fluorane, 2-(4-oxahexyl)-3-diethylamino-6-methyl-7-anilino fluorane, 2-(4-oxahexyl)-3-dipropylamino-6-methyl-7-anilino fluorane, 2-methyl-6-p-(p-dimethylaminophenyl)aminoanilino fluorane, 2-methoxy-6-p-(p-dimethylaminophenyl)aminoanilino fluorane, 2-chloro-3-methyl-6-p-(p-phenylaminophenyl)aminoanilino fluorane, 2-chloro-6-p-(p-dimethylaminophenyl)aminoanilino fluorane, 2-nitro-6-p-(p-diethylaminophenyl)aminoanilino fluorane, 2-amino-6-p-(p-diethylaminophenyl)aminoanilino fluorane, 2-diethylamino-6-p-(p-diethylaminophenyl)aminoanilino fluorane, 2-phenyl-6-methyl-6-p-(p-phenylaminophenyl)aminoanilino fluorane, 2-benzyl-6-p-(p-phenylaminophenyl)aminoanilino fluorane, 2-hydroxy-6-p-(p-phenylaminophenyl)aminoanilino fluorane, 3-methyl-6-p-(p-dimethylaminophenyl)aminoanilino fluorane, 3-diethylamino-6-p-(p-diethylaminophenyl)aminoanilino fluorane, 3-diethylamino-6-p-(p-dibutylaminophenyl)aminoanilino fluorane and 2,4-dimethyl-6-[(4-dimethylamino) anilino]fluorane.

<Fluorene Type Leuco Dye>

3,6,6-Tris(dimethylamino)spiro[fluorene-9,3'-phthalide] and 3,6,6'-tris(diethylamino)spiro[fluorene-9,3'-phthalide].

<Divinyl Type Leuco Dyes>

3,3-bis-[2-(p-dimethylaminophenyl)-2-(p-methoxyphenyl)ethenyl]-4,5,6,7-tetrabromophthalide, 3,3-bis-[2-(p-dimethylaminophenyl)-2-(p-methoxyphenyl)ethenyl]-4,5,6,7-tetrachlorophthalide, 3,3-bis-[1,1-bis(4-pyrrolidinophenyl)ethylene-2-yl]-4,5,6,7-tetrabromophthalide and 3,3-bis-[1-(4-methoxyphenyl)-1-(4-pyrolydinophenyl)ethylene-2-yl]-4,5,6,7-tetrchlorophthalide.

<Others>

3-(4-Diethylamino-2-ethoxyphenyl)-3-(1-ethyl-2-methylindol-3-yl)-4-azaphthalide, 3-(4-diethylamino-2-ethoxyphenyl)-3-(1-octyl-2-methylindol-3-yl)-4-azaphthalide, -(4-cyclohexyl ethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluorane-γ-(3'-nitro)anilinolactam, 3,6-bis(diethylamino)fluorane-γ-(4'-nitro) anilinolactam, 1,1-bis-[2',2',2",2"-tetrakis-(p-dimethylaminophenyl)-ethenyl]-2,2-dinitrilethane, 1,1-bis-[2',2',2",2"-tetrakis-(p-dimethylaminophenyl)-ethenyl]-2-β-naphthoylethane, 1,1-bis-[2',2',2",2"-tetrakis-(p-dimethylaminophenyl)-ethenyl]-2,2-thacetylethane and bis-[2,2,2',2'-tetrakis-(p-dimethylaminophenyl)-ethenyl]-methylmalonic acid dimethyl ester.

All of the color developing agents well known in the conventional field of pressure sensitive and thermosensitive recording media may be used as the color developing agent in a thermosensitive recording medium of the present invention. Although the dye is not particularly restricted, activated clay, attapulgite, colloidal silica, inorganic acidic substances such as aluminum silicate and the like, 4,4'-isopropylidene diphenol, 1,1-bis(4-hydroxyphenyl)cyclohexane, 2,2-bis(4-hydroxyphenyl)-4-methylpentane, 4,4'-dihydroxydiphenyl sulfide, hydroquinone monobenzyl ether, benzyl 4-hydroxybenzoate, 4,4'-dihydroxy diphenyl sulfone, 2,4'-dihydroxy diphenyl sulfone, 4-hydroxy-4'-isopropxy diphenyl sulfone, 4-hydroxy-4'-n-propoxy diphenyl sulfone, bis(3-allyl-4-hydroxyphenyl) sulfone, 4-hydroxy-4'-methyl diphenyl sulfone, 4-hydroxyphenyl-4'-benzyloxyphenyl sulfone, 3,4-dihydroxyphenyl-4'-methyl phenyl sulfone, aminobenzene sulfonamide derivatives described in Japanese Patent Application Public Disclosure No. 1108-59603, bis(4-hydroxyphenyl thioethoxy)methane, 1,5-di(4-hydroxyphenyl thio)-3-oxapentane, butyl bis(p-hydroxyphenyl)acetate, methyl bis(p-hydroxyphenyl)acetate, 1,1-bis(4-hydroxyphenyl)-1-phenyl ethane, 1,4-bis[α-methyl-α-(4'-hydroxyphenyl)ethyl]benzene, 1,3-bis[α-methyl-α-(4'-hydroxyphenyl) ethyl]benzene, di(4-hydroxy-3-methylphenyl)sulfide, 2,2'-thiobis(3-tert-octylphenol), 2,2'-thiobis(4-tert-octylphenol), phenolic compounds described in International Publication WO02/081229 or Japanese Patent Application Public Disclosure No. 2002-301873, thiourea compounds such as N,N'-di-m-chlorophenyl thiourea and the like, p-chlorobenzoic acid, stearyl gallate, bis[zinc 4-octyloxy carbonylamino]salicylate dihydrate, 4-[2-(p-methoxyphenoxy)ethyloxy]salicylic acid, 4-[3-(p-trisulfonyl)propyloxy]salicylic acid, aromatic carboxylic acids such as 5-[p-(2-p-methoxyphenoxyethoxy) cumyl]salicylic acid and salts of these aromatic carboxylic acids and polyvalent metals such as zinc, magnesium, aluminum, calcium, titanium, manganese, tin, nickel and the like, and, furthermore, antipirin complexes of zinc thiocyanate and complex zinc salts and the like of terephthal aldehyde acid with other aromatic carboxylic acids, for example, may be cited. These color developing agents may be used individually and in mixtures of at least two. In addition, high molecular weight aliphatic acid metal complex salts described in Japanese Patent Application Public Disclosure No. 1110-258577 and metal chelate type color development components such as polyvalent hydroxy aromatic compounds and the like may also be present.

Among these color developing agents, it is preferable to use a color developing agent of the following (1) to (3). These can prevent troubles of losing the ability to develop color over time, which is caused by the influence of adhesives. In addition, these can also prevent troubles of losing the adhesion of the adhesive layer when the label is heated to develop adhesion.

(1) Diphenyl sulfone cross-link type compound represented by the following formula (formula 1)

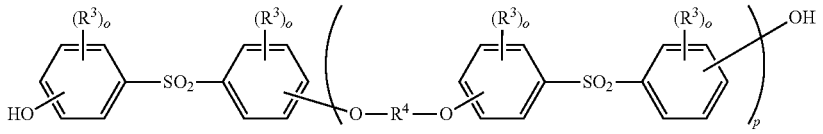

$R^3$, which may be identical or different, preferably identical, represents a hydrogen atom, a halogen atom, an alkyl group or an alkenyl group having 1 to 6 carbon atoms, preferably represents a hydrogen atom.

This alkyl group or alkenyl group is an alkyl or alkenyl group having 1-6 carbon atoms, for example, methyl, ethyl, n-propyl, isopropyl, n-butyl, sec-butyl, t-butyl, n-pentyl, isopentyl, neopentyl, t-pentyl, n-hexyl, iso-hexyl, 1-methylpentyl, 2-methylpentyl, vinyl, allyl, isopropenyl, 1-propenyl, 2-butenyl, 3-butenyl, 1,3-butadienyl, 2-methyl-2-propenyl and the like.

The halogen atom includes chlorine atom, bromine atom, fluorine atom or iodine atom, preferably represents chlorine atom or bromine atom.

o independently represents an integer of from 0 to 4, preferably 0.

OH group and —$OR^4O$— group preferably locate in a para-position to $SO_2$ group.

p is an integer of from 1 to 11. This compound is preferably a mixture of those in which p are from 1 to 11.

$R^4$, which may be identical or different, is preferably identical.

$R^4$ may be a hydrocarbon group having 1 to 12, preferably 3 to 7 carbon atoms, which may have an ether bond, which may be saturated or unsaturated, preferably saturated, which may be linear or branched, preferably linear. Such hydrocarbons includes a polyalkylene oxide chain or an alkylene group, preferably is a polyalkylene oxide chain. The polyalkylene oxide chain (—$OR^4O$—) includes —O—$(C_aH_{2a}O)_{1\sim3}$— in which a is 2 to 4, preferably 2 to 3, more preferably 2. The alkylene group includes —$C_b$H2b—, in which b is an arbitrary integer.

$R^4$ may be a substituted phenylene group represented by a general formula below:

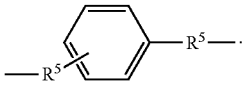

In the formula, $R^5$ represents a methylene group or ethylene group. $R^5$ preferably are in a para position each other.

In addition, $R^4$ may be a divalent group represented by a general formula below:

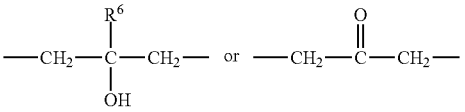

In the formula, $R^6$ represents a hydrogen atom or an alkyl group having 1 to 4 carbon atoms, preferably a hydrogen atom.

Among these, $R^4$ preferably is a hydrocarbon group having 1 to 12 carbon atoms, which may have an ether bond, which may be saturated or unsaturated, which may be linear or branched, as described above.

In this diphenyl sulfone cross-link type compound, the following may be mentioned as a group represented by $R^4$, which includes methylene, ethylene, trimethylene, tetramethylene, pentamethylene, hexamethylene, heptamethylene, octamethylene, nonamethylene, decamethylene, undecamethylene, dodecamethylene, methylmethylene, dimethylmethylene, methylethylene, methylene-ethylene, ethylethylene, 1,2-dimethyl-ethylene, 1-methyltrimethylene, 1-methyl-tetramethylene, 1,3-dimethyl-trimethylene, 1-ethyl-4-methyl-tetramethylene, vinylene, propenylene 2-butenylene, ethynylene, 2-butenylene, 1-vinylethylene, ethylene-oxy-ethylene, tetramethylene-oxy-tetramethylene, ethylene-oxy-ethylene-oxy-ethylene, ethylene-oxy-methylene-oxy-ethylene, 1,3-dioxane-5,5-bismethylene, 1,2-xylyl, 1,3-xylyl, 1,4-xylyl, 2-hydroxy trimethylene, 2-hydroxy-2-methyl trimethylene, 2-hydroxy-2-ethyl trimethylene, 2-hydroxy-2-propyl trimethylene, 2-hydroxy-2-isopropyl trimethylene, 2-hydroxy-2-butyl trimethylene and the like.

As a diphenyl sulfone cross-link type compound, a mixture of those with different substituents ($R^3$) and/or a different number of p may be used and these content ratios are arbitrary. And there's no particular limitation for a method to prepare the mixture, which may be mixing the powders, mixing the dispersions dispersed water or other solvent, producing multiple types of compounds simultaneously by adjusting the production condition and the like.

The compound represented by the general formula 1 includes, for example, 4,4'-bis [4-[4-(4-hydroxyphenyl sulfonyl)phenoxy]-2-trans-butenyloxy]diphenyl sulfone; 4,4'-bis [4-(4-hydroxyphenyl sulfonyl)phenoxy-4-butyloxy] diphenyl sulfone; 4,4'-bis [4-(4-hydroxyphenyl sulfonyl)phenoxy-3-propyloxy]diphenyl sulfone; 4,4'-bis [4-(4-hydroxyphenyl sulfonyl)phenoxy-2-ethyloxy]diphenyl sulfone; 4-[4-(4-hydroxyphenyl sulfonyl)phenoxy-4-butyloxy]-4'-[4-(4-hydroxyphenyl sulfonyl)phenoxy-3-propyl oxy]diphenyl sulfone; 4-[4-(4-hydroxyphenyl sulfonyl)phenoxy-4-butyloxy]-4'-[4-(4-hydroxyphenyl sulfonyl)phenoxy-2-ethyloxy]diphenyl sulfone; 4-[4-(4-hydroxyphenyl sulfonyl)phenoxy-3-propyloxy]-4'-[4-(4-hydroxyphenyl sulfonyl) phenoxy-2-ethyloxy]diphenyl sulfone; 4,4'-bis[4-(4-hydroxyphenyl sulfonyl)phenoxy-5-pentyloxy]diphenyl sulfone; 4,4'-bis[4-(4-hydroxyphenylsulfonyl)phenoxy-6-hexyloxy]diphenyl sulfone; 4-[4-[4-(4-hydroxyphenyl sulfonyl)phenoxy]-2-trans-butenyloxy]-4'-[4-(4-hydroxyphenyl phenylsulfonyl)phenoxy-4-butyloxy]diphenyl sulfone; 4-[4-(4-hydroxyphenyl sulfonyl)phenoxy-2-trans-butenyloxy]-4'-[4-(4-hydroxyphenyl sulfonyl)phenoxy-3-propyloxy]diphenyl sulfone; 4-[4-[4-(4-hydroxyphenyl sulfonyl)phenoxy]-2-trans-butenyloxy]-4'-[4-(4-hydroxyphenyl sulfonyl) phenoxy-2-ethyloxy]diphenyl sulfone; 1,4-bis[4-[4-[4-(4-hydroxyphenyl sulfonyl)phenoxy-2-trans-butenyloxy] phenylsulfonyl]phenoxy]-cis-2-butene; 1,4-bis[4-[4-[4-(4-hydroxyphenyl sulfonyl)phenoxy-2-trans-butenyloxy sulfonyl]phenylsulfonyl]phenoxy]-trans-2-butene; 4,4'-bis [4-[4-(2-hydroxyphenyl sulfonyl)phenoxy]butyloxy]diphenyl sulfone; 4,4'-bis [4-[2-(4-hydroxyphenyl sulfonyl)phenoxy]butyloxy]diphenyl sulfone; 4,4'-bis [4-(4-hydroxyphenyl sulfonyl)phenoxy-2-ethylene oxy ethoxy]diphenyl sulfone; 4,4'-bis [4-(4-hydroxyphenyl)phenyl-1,4-phenylenebismethyleneoxy]diphenyl sulfone; 4,4'-bis [4-(4-hydroxyphenyl)phenyl-1,3-phenylenebismethyleneoxy]diphenyl sulfone; 4,4'-bis [4-(4-hydroxyphenyl)phenyl-1,2-phenylenebismethyleneoxy]diphenyl sulfone; 2,2'-bis [4-[4-[4-(4-hydroxyphenyl sulfonyl)phenoxy-2-ethylene oxy-ethoxy] phenylsulfonyl]phenoxy]diethyl ether; α,α'-bis[4-[4-[4-(4-hydroxyphenylsulfonyl)phenyl-1,4-phenylene bismethyleneoxy]phenylsulfonyl]phenoxy]-p-xylene; α,α'-bis [4-[4-[4-(4-hydroxyphenylsulfonyl)phenyl-1,3-phenylene bis-methylene-oxy]phenyl sulfonyl]phenoxy]m-xylene; α,α'-bis[4-[4-[4-(4-hydroxyphenylsulfonyl)phenyl-1,2-phenylene bis-methylene-oxy]phenylsulfonyl]phenoxy]o-xylene; 2,4'-bis [2-(4-hydroxyphenyl sulfonyl)phenoxy-2-ethylene oxy ethoxy]diphenyl sulfone; 2,4'-bis [4-(2-hydroxyphenyl sulfonyl)phenoxy-2-ethylene oxy-ethoxy] diphenyl sulfone; 4,4'-bis[3,5-dimethyl-4-(3,5-dimethyl-4-hydroxyphenyl sulfonyl)phenoxy-2-ethylene oxy-ethoxy] diphenyl sulfone; 4,4'-bis[3-allyl-4-(3-allyl-4-hydroxyphenyl sulfonyl)phenoxy-2-ethylene oxy-ethoxy] diphenyl sulfone; 4,4'-bis[3,5-dimethyl-4-(3,5-dimethyl-4-hydroxyphenylsulfonyl)phenyl-1,4-phenylene bismethyleneoxy]diphenyl sulfone; 4,4'-bis[3,5-dimethyl-4-(3,5-dimethyl-4-hydroxyphenylsulfonyl)phenyl-1,3-phenylene bis-methylene oxy]diphenyl sulfone; 4,4'-bis [3,5-dimethyl-4-(3,5-methyl-4-hydroxyphenylsulfonyl)phenyl-1,2-phenylene bis-methylene oxy]diphenyl sulfone; 4,4'-bis[3-allyl-4-(3-allyl-4-hydroxyphenyl sulfonyl) 1,4-bis-phenylene bis-methylene oxy]diphenyl sulfone; 4,4'-bis [3-allyl-4-(3-allyl-4-hydroxyphenyl sulfonyl) 1,3-phenylene bis-methylene oxy]diphenyl sulfone; 4,4'-bis[3-allyl-4-(3-allyl-4-hydroxyphenyl sulfonyl) 1,2-phenylene bis-methylene oxy]diphenyl sulfone; 4,4'-bis[4-(4-hydroxyphenyl sulfonyl)phenoxy- 2-hydroxy propyl oxy]diphenyl sulfone; 1,3-bis[4-[4-[4-(4-hydroxyphenyl sulfonyl)phenoxy-2-hydroxypropyl oxy] phenylsulfonyl]phenoxy]-2-hydroxy-propane and the like.

When a mixture of several kinds of the diphenyl sulfone cross-link type compounds represented by the general formula 1 is used, a preferred composition comprises at least two different kinds of the compounds in which $R^3$ are identical but p values are different. The method for producing such composition is simple and several compounds having different p values can be synthesized at any ratio at a time.

Among these, the compound with p=1 includes, for example, 1,3-bis [4-(4-hydroxyphenyl sulfonyl)phenoxy]-2-hydroxy-propane; 1,1-bis[4-(4-hydroxyphenyl sulfonyl)phenoxy]methane 1,2-bis[4-(4-hydroxyphenyl sulfonyl)phenoxy]ethane; 1,3-bis [4-(4-hydroxyphenyl sulfonyl) phenoxy]propane; 1,4-bis[4-(4-hydroxyphenyl sulfonyl) phenoxy]butane; 1,5-bis[4-(4-hydroxyphenyl sulfonyl) phenoxy]pentane; 1,6-bis [4-(4-hydroxyphenyl sulfonyl) phenoxy]hexane; α,α'-bis[4-(4-hydroxyphenyl sulfonyl) phenoxy]-p-xylene; α,α'-bis[4-(4-hydroxyphenyl sulfonyl) phenoxy]-m-xylene; α,α'-bis [4-(4-hydroxyphenyl sulfonyl) phenoxy]-o-xylene; 2,2'-bis[4-(4-hydroxyphenyl sulfonyl) phenoxy]diethyl ether; 4,4'-bis[4-(4-hydroxyphenyl sulfonyl)phenoxy]dibutyl ether; 1,2-bis [4-(4-hydroxyphenyl sulfonyl)phenoxy]ethylene; 1,4-bis[4-(4-hydroxyphenyl sulfonyl)phenoxy]-2-butene (for example, Japanese Patent Application Public Disclosure (Kokai) 1107-149713, International Publication WO93/06074 and WO95/33714, etc.).

As such a compound, D90 manufactured by Nippon Soda Co., Ltd. represented formula below is commercially available.

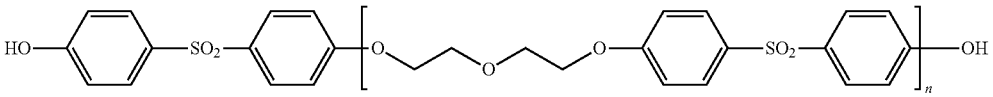

(mixture of n = 1 to 11)

(2) Urea-urethane compound represented by the following formula (formula 5)

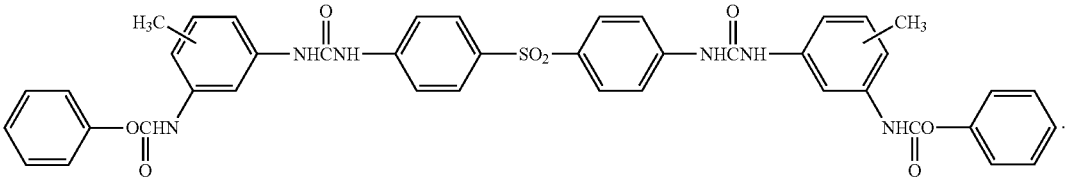

As such urea-urethane compound, mixtures of isomers of methyl substituents in different positions in the formula, UU manufactured by Chemipro Kasei Kaisha, Ltd. is commercially available.

(3) Diphenyl sulfone derivatives represented by the following formula (formula 6)

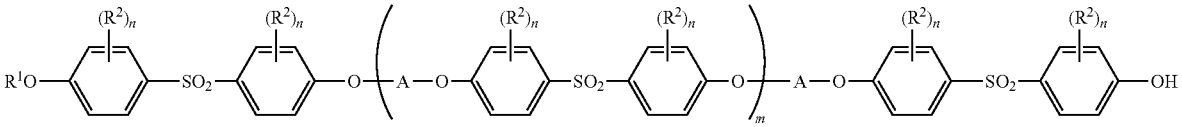

In the formula, $R^1$ represents a hydrocarbon group having 1 to 12, preferably 1 to 5, more preferably 1 to 4 carbon atoms, which may be saturated or unsaturated, which may be linear or branched. Such saturated hydrocarbon group includes, for example, methyl, ethyl, n-propyl, isopropyl, n-butyl, t-butyl, isoamyl and the like. The unsaturated hydrocarbon preferably has from 2 to -5 carbon atoms. And such unsaturated hydrocarbon includes, for example, ethylene, 1-n-propylene, 2-n-propylene, iso-propylene, 1-n-butylene, 2-n-butylene, 3-n-butylene and the like.

$R^2$ each independently represents a halogen atom, or an alkyl or alkenyl group having 1 to 12 carbon atoms. As the halogen atom, chlorine, bromine, fluorine and iodine are mentioned and chlorine and bromine are preferred.

The alkyl group is linear or branched saturated alkyl group having 1 to 12, preferably 1 to 5, more preferably 1 to 4 carbon atoms. The alkyl group is, for example, methyl, ethyl, n-propyl, isopropyl, n-butyl, t-butyl, n-pentyl, isopentyl, neopentyl, t-pentyl, n-hexyl, isohexyl, 1-methylpentyl, 2-methylpentyl and the like.

The alkenyl group is linear or branched unsaturated alkyl group having 2 to 12 carbon atoms. The alkenyl group is, for example, vinyl, allyl, isopropenyl, 1-propenyl, 2-butenyl, 3-butenyl, 1,3-butadienyl, 2-methyl-2-propenyl and the like. Among these, vinyl and allyl are preferred.

n is an integer of from 0 to 4, preferably from 0 to 2, more preferably 0. If n is 2 to 4, $R^2$, which bind to the same benzene ring, may be identical or different, preferably identical.

A each independently represents a linear or branched, saturated or unsaturated hydrocarbon group having 1 to 12 carbon atoms, preferably a linear and saturated hydrocarbon group, which may have ether bond, more preferably a linear and saturated hydrocarbon group having no ether bond.

As the saturated hydrocarbon group of A, a linear or branched saturated hydrocarbon having 1 to 12, preferably 2 to 6, more preferably 3 to 4 carbon atoms may be cited. Examples of saturated hydrocarbons preferably includes, methylene, ethylene, trimethylene, tetramethylene, pentamethylene, hexamethylene, heptamethylene, octamethylene, nonamethylene, decamethylene, undecamethylene, dodecamethylene, methyl methylene, dimethylmethylene, methylethylene, methylene-ethylene, ethyl-ethylene, 1,2-dimethylethylene, 1-methyl trimethylene, 1-methyl-tetramethylene, 1,3-dimethyl trimethylene, 1-ethyl-4-methyl-tetramethylene and the like. Among these, a saturated hydrocarbon group 2-6 carbon atoms such as ethylene, trimethylene, tetramethylene, pentamethylene, hexamethylene and the like are preferred.

As the unsaturated hydrocarbon group of A, a linear or branched unsaturated hydrocarbon having 1 to 12, preferably 2 to 6, more preferably 2 to 4 carbon atoms may be cited. Examples of unsaturated hydrocarbons preferably includes, vinylene, ethynylene, propenylene, 2-butenylene, 2-butynylene, 1-vinyl-ethylene and the like. Among these, a hydrocarbon group such as, propenylene, 2-butenylene are preferred.

As the hydrocarbon group having ether bond, for example, ethylene-oxy-ethylene, tetramethylene-oxy-tetramethylene, ethylene-oxy-ethylene-oxy-ethylene, ethylene-oxy-methylene-oxy-ethylene, 1,3-dioxane, 5,5-bismethylene and the like may be cited. Among these, ethylene-oxy-ethylene, ethylene-oxy-ethylene-oxy-ethylene are preferred.

m represents an integer of from 0 to 5, preferably from 0 to 2, more preferably 0.

The diphenyl sulfone derivatives of the above formula 6 may be a compound having a particular m in formula 6, or a mixture of different compounds in any proportion having different m's.

The diphenyl sulfone derivatives described above includes, for example, the following compounds, but is not limited to these.

1-[4-(4-hydroxyphenyl sulfonyl)phenoxy]-2-[4-(4-isopropoxy phenylsulfonyl)phenoxy]ethane, 1-[4-(4-hydroxyphenyl sulfonyl)phenoxy]-3-[4-(4-isopropoxy phenylsulfonyl)phenoxy]propane, 1-[4-(4-hydroxyphenyl sulfonyl) phenoxy]-4-[4-(4-isopropoxy phenylsulfonyl)phenoxy] butane, 1-[4-(4-hydroxyphenyl sulfonyl)phenoxy]-5-[4-(4-isopropoxy phenylsulfonyl)phenoxy]pentane, 1-[4-(4-hydroxyphenyl sulfonyl)phenoxy]-6-[4-(4-isopropoxy phenylsulfonyl)phenoxy]hexane, 1-[4-(4-hydroxyphenyl sulfonyl)phenoxy]-7-[4-(4-iso propoxy phenylsulfonyl)phenoxy]heptane, 1-[4-(4-hydroxyphenyl sulfonyl)phenoxy]-8-[4-(4-isopropoxy phenylsulfonyl)phenoxy]-octane, 4-(4-[4-(4-hydroxyphenyl sulfonyl)phenoxy]butoxy)-4'-(4-[4-(4-methoxy phenylsulfonyl)phenoxy]butoxy)diphenyl sulfone, 4-(4-(2-(4-(4-(2-(4-(4-(2-(4-(4-methoxy phenylsulfonyl) phenoxy)butoxy)phenylsulfonyl)phenoxy)butoxy)phenyl-sulfonyl)phenoxy)butoxy)phenyl sulfonyl)phenol and the like. Among these, 1-(4-(4-hydroxyphenyl sulfonyl)phenoxy)-4-(4-(4-isopropoxy phenylsulfonyl)phenoxy)butane is preferred due to a good balance of sensitivity and storagebility.

Among these diphenyl sulfone derivatives, 1-[4-(4-hydroxyphenyl sulfonyl)phenoxy]-4-[4-(4-isopropoxy phenylsulfonyl)phenoxy]butane is available as JKY-214 manufactured by API Corporation.

As the sensitizer used in the present invention, previously well known sensitizers may be used. Such sensitizer includes, for example, aliphatic acid amides such as stearic acid amide, palmitic acid amide and the like, ethylene bis-amide, montanoic acid wax, polyethylene wax, 1,2-di-(3-methylphenoxy)ethane, p-benzyl biphenyl, β-benzyloxy naphthalene, 4-biphenyl-p-tolyl ether, m-terphenyl, 1,2-diphenoxy ethane, dibenzyl oxalate, di-(p-chlorobenzyl)oxalate, bis-para-methylbenzyl oxalate, dibenzyl terephthalate, benzyl p-benzyloxybenzoate, di-p-tolyl carbonate, phenyl-α-naphthyl carbonate, 1,4-diethoxy naphthalene, 1-hydroxy-2-naphthoic acid phenyl ester, o-xylene-bis-(phenyl ether), 4-(m-methylphenoxymethyl)biphenyl, 4,4'-ethylene dioxy-bis-benzoic acid dibenzyl ester, dibenzoyloxy methane, 1,2-di(3-methylphenoxy)ethylene, bis[2-(4-methoxy phenoxy)ethyl]ether, methyl p-nitrobenzoate and phenyl p-toluene sulfonate. However, the examples are not particularly restricted to the examples listed. The sensitizers may be used individually or as mixtures of at least two of them.

As stabilizers in the present invention that impart oil resistance and the like to recorded images, 4,4'-butylidene (6-t-butyl-3-methylphenol), 2,2'-di-t-butyl-5,5'-dimethyl-4,4'-sulfonyl diphenol, 1,1,3-tris(2-methyl-4-hydroxy-5-cyclohexylphenyl)butane, 1,1,3-tris(2-methyl-4-hydroxy-5-t-butylphenyl)butane and the like may be used in combination in ranges that do not interfere with the desired effects on the tasks described above.

In a thermosensitive recording medium of the present invention, a binder, a list of examples of which include completely saponified poly(vinyl alcohol), partially saponified poly(vinyl alcohol), acetoacetylated poly(vinyl alcohol), carboxyl modified poly(vinyl alcohol), amide modified poly(vinyl alcohol), sulfonic acid modified poly(vinyl alcohol), butyral modified poly(vinyl alcohols), olefin modified poly (vinyl alcohol), nitrile modified poly(vinyl alcohol), pyrrolidone modified poly(vinyl alcohol), silicone modified poly (vinyl alcohol), other modified poly(vinyl alcohols), hydroxyethyl cellulose, methyl cellulose, ethyl cellulose, carboxymethyl cellulose, styrene-maleic anhydride copolymer, styrene-butadiene copolymer as well as cellulose derivatives such as ethyl cellulose and acetyl cellulose, casein, gum Arabic, oxidized starch, etherized starch, dialdehyde starch, esterified starch, poly(vinyl chloride), poly(vinyl acetate), polyacrylamide, polyacrylate ester, poly(vinyl butyral), polystyrose and its copolymers, polyamide resin, silicone resin, petroleum resin, terpene resin, ketone resin, cumaro resin and the like, may be present. The polymeric substances may be used upon dissolving in a solvent such as water, alcohol, ketones, esters, hydrocarbons and the like or in the form of an emulsion or paste dispersed in water or other media and in combination depending on the required qualities.

As the crosslinking agent used in the present invention, glyoxal, methylol melamine, melamine formaldehyde resins, melamine urea resins, polyamine epichlorohydrin resins, polyamide epichlorohydrin resins, potassium persulfate, ammonium persulfate, sodium persulfate, ferric chloride, magnesium chloride, borax, boric acid, alum, ammonium chloride and the like may be listed as examples.

As the pigment used in the present invention, inorganic and organic fillers such as silica, calcium carbonate, kaolin, calcined kaolin, diatomaceous earth, talc, titanium oxide, aluminum hydroxide and the like may be cited.

As the slip agent used in the present invention, fatty acid metal salts such as zinc stearate, calcium stearate and the like, wax, silicone resins and the like may be cited.

In addition, ultraviolet ray absorption agents, dispersion agents, defoaming agents, oxidation inhibitors, fluorescent dye and the like may also be used.

The types and amounts of the dye, color developing agents and various other components used in the thermosensitive recording layer of the present invention are decided according to performance and recording properties. The amounts are not particularly limited, but the color developing agent is ordinarily used at about 0.5 to 10 weight parts per one part of dye, the sensitizer is used at about 0.5 to 10 weight parts, the stabilizing agent is used at about 0.01 to 10 weight parts and other components are used at about 0.01 to 10 weight parts.

The dye, color developing agent and other materials added when needed are ground into particles several microns in size or smaller using a grinder or emulsification device such as a ball mill, attriter, sand grinder and the like. A binder and various additives are added depending on the objective of preparing a coating solution. Water, an alcohol and the like may be used as the solvent used to prepare the coating solution, and the solid fraction is present at about 20 wt. % to 40 wt. %.

The intermediate layer of the present invention usually comprises a pigment and a binder, and may further comprise a crosslinking agent.

The pigment may be any pigment that can be used in a thermosensitive recording layer, which is described above, and the pigment may include, for example, organic particles made of polyethylene resin, styrene/butadiene copolymer, styrene/acrylic resin copolymer and the like. The organic particles may be hollow and the average particle diameter is preferably equal to or less than about 5.0 μm.

As the binder and the crosslinking agent, any binder and crosslinking agent that can be used in a thermosensitive recording layer, which is described above, can be used.

Among them, the intermediate layer preferably comprises, (a) a resin containing a carboxyl groups, (b) epichlorohydrin type resins and (c) polyamine type resin/polyamide type resins.

The resin containing carboxyl groups includes, for example, a resin that contains monofunctional acrylic monomer containing carboxyl groups such as methacrylic acid, 2-hydroxyethyl methacrylate, 2-hydroxypropyl methacrylate, dimethyl aminoethyl methacrylate, diethyl aminoethyl methacrylate, t-butyl aminoethyl methacrylate, glycidyl methacrylate, tetrahydro furfuryl methacrylate and the like, oxidized starch, carboxymethyl cellulose, poly(vinyl alcohol) modified with carboxyl groups obtained by introducing carboxyl groups to poly(vinyl alcohol) and the like may be cited. However, the use of a carboxyl modified poly(vinyl alcohol) with excellent heat and solvent resistance is particularly preferred.

The carboxyl modified polyvinyl alcohol is produced as a reaction product between polyvinyl alcohol and multi-valent carboxylic acid such as fumaric acid, phthalic anhydride, mellitic anhydride, and itaconic anhydride; or an esterified products of these reactants; or a saponified product of a copolymer between vinyl acetate and ethylated unsaturated dicarboxylic acid such as maleic acid, fumaric acid, itaconic acid, crotonic acid, acrylic acid, and metacrylic acid. Specifically, the production process includes, for example, the production process exemplified in Example 1 or 4 of Japanese Patent Application Public Disclosure No. 53-91995, publication. Moreover, the saponification value of the carboxyl modified polyvinyl alcohol is preferably ranging from 72 to 100 mol %, and the degree of polymerization is ranging from 500 to 2400, preferably from 1000 to 2000.

Specific examples of the epichlorohydrin resin include a polyamide epichlorohydrin resin, a polyamine epichlorohydrin resin and the like, and these compounds can be used solely or in combination. As the amines in backbone chain of the epichlorohydrin resin, any amine from primary amines to quaternary amines can be used without restrictions. Furthermore, the cationization level of the epichlorohydrin resin is preferably less than 5 meq/g·solid (measured at pH 7) and the molecular weight is preferably more than 500,000, since the epichlorohydrin resin has a good water resistance. Specific examples of the epichlorohydrin resin include Sumirez resin 650(30), Sumirez resin 675A, Sumirez resin 6615 (Sumitomo Chemicals), WS4002, WS4020, WS4024, WS4046, WS4010, and CP8970 (SeikoPMC).

The polyamine/amide resin includes polyamide urea resin, polyalkylene polyamine resin, polyalkylene polyamide resin, polyamine polyurea resin, modified polyamine resin, modified polyamide resin, polyalkylene polyamine urea formalin resin, and polyalkylene polyamine polyamide polyurea resin. Specific examples include Sumirez resin 302 (Sumitomo Chemicals: polyamine polyurea resin), Sumirez resin 712 (Sumitomo Chemicals: polyamine polyurea resin), Sumirez resin 703 (Sumitomo Chemicals: polyamine polyurea resin), Sumirez resin 636 (Sumitomo Chemicals: polyamine polyurea resin), Sumirhez resin SPI-100 (Sumitomo Chemicals: modified polyamine resin), Sumirez resin SPI-102A (Sumitomo Chemicals: modified polyamine resin), Sumirez resin SPI-106N (Sumitomo Chemicals: modified polyamide resin), Sumirez resin SPI-203(50) (Sumitomo Chemicals), Sumirez resin SPI-198 (Sumitomo Chemicals), PrintiveA-700 (Asahi Kasei Corporation), PrintiveA-600 (Asahi Kasei Corporation), PA6500, PA6504, PA6634, PA6638, PA6640, PA6644, PS6646<PA6654, PA6702, PA 6704 (the above, SeikoPMC: polyalkylene polyamine polyamide polyurea resin), and CP8994 (SeikoPMC: polyethylene imine resin) without any restriction, they can be used solely or in combination of two kinds or more. From the viewpoint of recording sensitivity, polyamine resin (polyalkylene polyamine resin, polyamine polyurea resin, modified polyamine resin, polyalkylene polyamine urea formalin resin, polyalkylene polyamine polyamide polyurea resin) are preferable.

The contents of these ingredients in the intermediate layer not particularly restricted. Ordinarily, however, the content of the resin containing carboxyl groups is preferably ranging from 1 to 80 weight parts, more preferably from 10 to 60 weight parts, based on 100 weight parts of the pigment.

The contents of the epichlorohydrin resin and the polyamine/amide resin are preferably independently ranging from 1 to 100 weight parts, more preferably from 5 to 50 weight parts based on 100 weight parts of the resin containing carboxyl groups.

The coating amount for the intermediate layer is ordinarily in the range of from 1 $g/m^2$ to 15 $g/m^2$.

The intermediate layer may further contain water resistant agents, defoamers, lubricants, and the like.

In addition, the means by which the coating solution is applied is not particularly restricted, and a commonly used technology may be used, such as gravure coaters, roller coaters, rip coaters, bar coaters.

EXAMPLES

The following examples will illustrate the present invention, but these are not intended to restrict the present invention.

The solutions A to C are prepared and these solutions were separately wet ground using sand grinders until the average particle size was about 0.5 μm.

Solution A (Color Developing Agent Dispersion)

| | |
|---|---|
| Diphenyl sulfone cross-link type compound (Nippon Soda Co., Ltd. D90) | 6.0 parts |
| 10% Aqueous solution of polyvinyl alcohol | 18.8 parts |
| Water | 11.2 parts |

Solution B (Dye Dispersion)

| | |
|---|---|
| 3-Dibutylamino-6-methyl-7-anilinofluorane (Yamamoto Chemicals Inc. ODB-2) | 3.0 parts |
| 10% Aqueous solution of polyvinyl alcohol | 6.9 parts |
| Water | 3.9 parts |

Solution C (Sensitizer Dispersion)

| | |
|---|---|
| 1,2-bis-(3-methylphenoxy) ethane (Sanko Co., Ltd. KS232) | 6.0 parts |
| 10% Aqueous solution of polyvinyl alcohol | 18.8 parts |
| Water | 11.2 parts |

Next the dispersions were blended in the proportion described below to prepare a thermosensitive recording layer coating solution.

Thermosensitive Recording Layer Coating Solution

| | |
|---|---|
| Solution A (color developing agent dispersion) | 36.0 parts |
| Solution B (dye dispersion) | 13.8 parts |
| Solution C (sensitizer dispersion) | 36.0 parts |
| Silica (Mizusawa Industrial Chemicals, Ltd. P537) 25% dispersion | 17.5 parts |
| 10% Aqueous solution of polyvinyl alcohol | 25.0 parts |

In addition, each coating solution with following formulation was prepared.

Heat Activated Tackifier Coating Solution:

| | |
|---|---|
| Heat activated tackifier (Daicel FineChem Ltd. Ecobrid S-1, activation temperature 90° C.) | 100.0 parts |
| Thickening agent (San Nopco Ltd. SN Thickener 929S) | 0.5 parts |

Intermediate Layer Coating Solution 1:

| | |
|---|---|
| Acrylic resin (Mitsui Chemicals Inc. Barrierstar B1000) | 90 parts |
| Polyamide-epichlorohydrin resin (Seiko PMC Corporation WS4030) | 10 parts |

Intermediate Layer Coating Solution 2:

| | |
|---|---|
| Carboxyl modified polyvinyl alcohol (Kuraray Co., Ltd. PVA-KL318) 10% solution | 85 parts |
| Polyamide-epichlorohydrin resin (Seiko PMC Corporation, WS4030) | 15 parts |

Intermediate Layer Coating Solution 3:

| | |
|---|---|
| Carboxyl modified polyvinyl alcohol (Kuraray Co., Ltd. PVA-KL318) 10% solution | 85 parts |
| Polyamide-epichlorohydrin resin (Seiko PMC Corporation, WS4030) | 8 parts |
| Modified polyamine resin (Sumitomo Chemical Co., Ltd., Sumirez Resin SPI-102A) | 7 parts |

Protective Layer Coating Solution:

| | |
|---|---|
| Carboxyl modified polyvinyl alcohol (Kuraray Co., Ltd. PVA-KL318) 10% solution | 90 parts |
| Polyamide-epichlorohydrin resin (Seiko PMC Corporation, WS4030) | 10 parts |

Example 1

The thermosensitive recording layer coating solution was applied to one side of PET film (A4300 manufactured by Toyobo Co., Ltd., 38 μm thick, total light transmittance of 90%) and was dried for 2 minutes using a forced air dryer at 60° C. so that the coating amount is 4.0 g/m$^2$. Then the heat activated tackifier coating solution was applied on this using a Mayer bar with a coating amount of 10.0 g/m$^2$ and was dried for 5 minutes using a forced air dryer at 50° C. to yield a thermosensitive recording label.

Example 2

A thermosensitive recording label was prepared in the same manner described in Example 1 with the exception of changing the sensitizer in the thermosensitive recording layer coating solution to a urea-urethane compound (UU manufactured by Chemipro Kasei Kaisha, Ltd.).

Example 3

A thermosensitive recording label was prepared in the same manner described in Example 1 with the exception of changing the sensitizer in the thermosensitive recording layer coating solution to 1-[4-(4-hydroxyphenyl sulfonyl)phenoxy]-4-[4-(4-isopropoxy phenylsulfonyl)phenoxy]butane (JKY-214 manufactured by API Corporation).

Example 4

A thermosensitive recording label was prepared in the same manner described in Example 1 with the exception of changing the heat activated tackifier to Heat-magic DW1040 (Toyo Ink Co., Ltd., thermal activation temperature 50° C.) and changing the drying temperature after the coating to 40° C.

Example 5

A thermosensitive recording label was prepared in the same manner described in Example 1 with the exception of changing the heat activated tackifier to Ecobrid 5610 (Daicel FineChem. Ltd., thermal activation temperature 70° C.) and changing the drying temperature after the coating to 45° C.

Example 6

A thermosensitive recording label was prepared in the same manner described in Example 1 with the exception of changing the color developing agent to 4-hydroxy-4'-allyloxy diphenyl sulfone (BPS-MAE manufactured by Nicca Chemical Co., Ltd.) in the thermosensitive recording layer.

Example 7

A thermosensitive recording label was prepared by applying an acrylic adhesive (SK Dine 701 manufactured by Soken Chemical & Engineering Co., Ltd.) on the PET film coated with the thermosensitive recording layer coating solution prepared in Example 6 so that the coating amount is 10 g/m$^2$. Thus obtained label was laminated with a release paper (silicone processed PET film of 11 μm thickness) and was stored.

Example 8

The intermediate layer coating solution 1 was applied on the PET film coated with the thermosensitive recording layer coating solution prepared in Example 1 so that the coating amount is 2.0 g/m$^2$ and was dried for 2 minutes using a forced air dryer at 60° C. Then the heat activated tackifier coating solution was applied on this using a Mayer bar with a coating amount of 10.0 g/m$^2$ and was dried for 5 minutes using a forced air dryer at 50° C. to yield a thermosensitive recording label.

Example 9

A thermosensitive recording label was prepared in the same manner described in Example 8 with the exception of changing the intermediate layer coating solution 1 to the intermediate layer coating solution 2.

Example 10

A thermosensitive recording label was prepared in the same manner described in Example 8 with the exception of changing the intermediate layer coating solution 1 to the intermediate layer coating solution 3.

Example 11

The intermediate layer coating solution 3 was applied on the PET film coated with the thermosensitive recording layer coating solution prepared in Example 6 so that the coating amount is 2.0 g/m$^2$ and was dried for 2 minutes using a forced air dryer at 60° C. Then the heat activated tackifier coating solution was applied on this using a Mayer bar with a coating amount of 10.0 g/m$^2$ and was dried for 5 minutes using a forced air dryer at 50° C. to yield a thermosensitive recording label.

Comparative Example 1

A thermosensitive recording layer coating solution was prepared by changing the color developing agent to 4-hydroxy-4'-allyl-oxy diphenyl sulfone (BPS-MAE manufactured by Nicca Chemical Co., Ltd.) in the thermosensitive recording layer coating solution and this thermosensitive recording layer coating solution was applied to one side of PET film (A4300 manufactured by Toyobo Co., Ltd.) and was dried for 2 minutes using a forced air dryer at 60° C. so that the dried coating amount is 4.0 g/m$^2$. Then the heat activated tackifier coating solution was applied on this using a Mayer bar with a coating amount of 10.0 g/m$^2$ and was dried for 5 minutes using a forced air dryer at 50° C. to yield a thermosensitive recording label.

Comparative Example 2

A thermosensitive recording layer coating solution was prepared by changing the color developing agent to 4-hydroxy-4'-allyl-oxy diphenyl sulfone (BPS-MAE manufactured by Nicca Chemical Co., Ltd.) in the thermosensitive recording layer coating solution and this thermosensitive recording layer coating solution was applied to one side of PET film (A4300 manufactured by Toyobo Co., Ltd.) and was dried for 2 minutes using a forced air dryer at 60° C. so that the dried coating amount is 4.0 g/m$^2$. The protective layer coating solution was applied on the thermosensitive recording layer and was dried for 2 minutes using a forced air dryer at 60° C. so that the dried coating amount is 4.0 g/m$^2$. Then the heat activated tackifier coating solution was applied on the other side of this using a Mayer bar with a coating amount of 10.0 g/m$^2$ and was dried for 5 minutes using a forced air dryer at 50° C. to yield a thermosensitive recording label.

The following evaluations were conducted on the thermosensitive recording labels obtained above.

<Developed Color Intensity>

A check pattern was printed on the prepared thermosensitive recording medium by a printing tester for thermosensitive recording paper (Ohkura Engineering Co. LTD., TH-PMD equipped with a thermal head by Kyosera Co.) at recording energy of 0.39 mJ/dot so that the tackifier coated surface was in contact with the thermal head for the thermosensitive recording labels from the Examples with the exception of Example 7. The thermosensitive recording label from Example 7 was positioned so that the release paper was in contact with the thermal head. The thermosensitive recording labels from Comparative Examples 1 and 2 were positioned so that the thermosensitive recording layer coated surface was in contact with the thermal head.

The density of the printed image was measured and evaluated by using Macbeth Densitometer (RD-914). The density of the printed image of the film surface was measured for the thermosensitive recording labels from Examples 1 to 10, and the density of the printed image of the thermosensitive recording layer coated surface was measured for the thermosensitive recording labels from Comparative Examples 1 and 2.

<Water Resistance>

A check pattern was printed on the tackifier layer surface of the thermosensitive recording labels from the examples, with the exception of Example 7, by a printing tester for thermosensitive recording paper (Ohkura Engineering Co. LTD., TH-PMD equipped with a thermal head by Kyosera Co.) at recording energy of 0.39 mJ/dot. The thermosensitive recording label from Example 7 was similarly printed on top of the release paper. The thermosensitive recording labels from Comparative Examples 1 and 2 were similarly printed on the thermosensitive recording layer surface and on the heat activated tackifier layer surface in that order (that is, it was printed twice).

The thermosensitive recording labels were covered with a polyolefin wrap (One Wrap manufactured by Nippon Paper-Pak Co., Ltd.), immersed in tap water and left standing for 24 hours. The intensity of the developed color section before and after the treatment was measured, and the residual ratio [=developed color intensity after the treatment/developed color intensity before the treatment×100(%)] was calculated.

The intensity of the recorded section was measured by using Macbeth Densitometer (RD-914) and was evaluated.

Good: The residual ratio was at least 90%.

Poor: The residual ratio was less than 90%.

<Photoresistance>

Thermosensitive recording labels printed as they were for the water resistance test were attached to a polyolefin wrap (One Wrap manufactured by Nippon Paper-Pak Co., Ltd.) and were exposed for 24 hours in a Xenon fadeometer, Atlas Ci3000F, at an output power of 67 W/m$^2$. The intensity in the developed color section before and after the treatment was measured and the residual ratio [=developed color intensity after the treatment/developed color intensity before the treatment×100(%)] was calculated.

Good: The residual ratio was at least 90%

Poor: The residual ratio was less than 90%.

<Prevention of Desensitization>

After the thermosensitive recording labels prepared were left standing for 7 days in an environment maintained at 40° C. and 80% RH, a check pattern was printed on the prepared thermosensitive recording medium by a printing tester for thermosensitive recording paper (Ohkura Engineering Co. LTD., TH-PMD equipped with a thermal head by Kyosera Co.) at recording energy of 0.39 mJ/dot so that the tackifier coated surface was in contact with the thermal head for the thermosensitive recording labels from the Examples with the exception of Example 7. The thermosensitive recording label from Example 7 was positioned so that the release paper was in contact with the thermal head. The thermosensitive recording labels from Comparative Examples 1 and 2 were positioned so that the thermosensitive recording layer coated surface was in contact with the thermal head. The developed color intensity of the printed section was measured, and the color developing capacity before and after the treatment was evaluated according to the equation shown below. The intensity of the recorded section was measured by using Macbeth Densitometer (RD-914).

Prevention of desensitization=(developed color intensity after 7 days of standing/developed color intensity before 7 days of standing)×100%

Excellent: Prevention of desensitization of at least 85%.

Good: Prevention of desensitization of from at least 75% to less than 85%.

Fair: Prevention of desensitization of from at least 65% to less than 75%.

Poor: Prevention of desensitization of 65% or less.

<Printed Image Retention>

The tackifier coated surfaces of the thermosensitive recording labels from the Examples and Comparative Examples 1 and 2 were solidly printed using a thermosensitive printer (140XiIII manufactured by Zebra Co., Ltd., clarity+20, printing speed 51 mm/second), and energy was delivered to the surface to generate tackiness. The printed thermosensitive recording labels were left standing for 10 seconds and subsequently were attached to a polyolefin wrap (One Wrap manufactured by Nippon Paper-Pak Co., Ltd.). The thermosensitive recording label from Example 7 was attached after peeling the release paper. After the attachment, the labels were left standing for 5 hours in an environment maintained at 23° C. and 50% RH. The intensity of the developed color section before and after the treatment was measured, and Printed image retention [=(the developed color intensity after 5 days of standing/developed color intensity before 5 days of standing)×100(%)] was calculated.

Excellent: Printed image retention of at least 85%.

Good: Printed image retention of at least 70% to less than 85%.

Fair: Printed image retention of at least 50% to less than 70%.

Poor: Printed image retention of 50% or less.

<Adhesion>

The tackifier coated surface of the thermosensitive recording labels from the Examples and Comparative Examples 1 and 2, with the exception of the film from Example 7, was solidly printed using a thermosensitive printer (140XiIII manufactured by Zebra Co., Ltd., clarity+20, printing speed 51 mm/second), and energy was delivered to the surface to generate tackiness. The printed thermosensitive recording labels were left standing for 10 seconds and were subsequently attached to a polyolefin wrap (One Wrap manufactured by Nippon Paper Pak Co., Inc.). The thermosensitive recording label from Example 7 was attached after peeling the release paper.

After the attachment, the labels were left standing for 24 hours in an environment maintained at 23° C. and 50% RH and a peeling test was conducted. The labels were evaluated according to the standards below.

Good: Bonded.

Poor: Did not bond.

<Blocking Resistance>

The thermosensitive recording labels from the Examples and Comparative Examples 1 and 2, with the exception of the label from Example 7, were wound on a 3 inch paper tube and were left standing for 24 hours in an environment maintained at 40° C. and 80% RH or 50° C. and 80% RH. The thermosensitive recording labels were subsequently peeled from the paper tube, and the feeling of resistance (blocking resistance) when peeled was evaluated. The thermosensitive recording label from Example 7 was not evaluated.

Good: The thermosensitive recording label was peeled from the paper tube without resistance.

Fair: A slight resistance was felt when peeling, and the surface of the paper tube looked fuzzy. However, the paper was not removed from the paper tube, and the thermosensitive recording label was not torn.

Poor: A resistance was felt when peeling, and the paper was torn from the paper tube or the thermosensitive recording label was torn when the label was forcibly removed.

The compositions of the thermosensitive recording labels are shown in Table 1, and evaluation results are shown in Table 2.

TABLE 1

| | Thermosensitive recording layer side | | | |
|---|---|---|---|---|
| | Tackifier | Heat activation temp. (° C.) | Color developing agent | Inrermediate layer |
| Example 1 | Ecobrid S-1 | 90 | D90 | — |
| Example 2 | Ecobrid S-1 | 90 | UU | — |
| Example 3 | Ecobrid S-1 | 90 | JKY-214 | — |
| Example 4 | Heat Magic DW1040W | 50 | D90 | — |
| Example 5 | Ecobrid 5610 | 70 | D90 | — |
| Example 6 | Ecobrid S-1 | 90 | BPS-MAE | — |
| Example 7 | Acrylic tackifier | <40 | BPS-MAE | — |
| Example 8 | Ecobrid S-1 | 90 | D90 | installed |
| Example 9 | Ecobrid S-1 | 90 | D90 | installed |
| Example 10 | Ecobrid S-1 | 90 | D90 | installed |
| Example 11 | Ecobrid S-1 | 90 | BPS-MAE | installed |
| Comp. Example 1 | — | — | BPS-MAE | — |
| Comp. Example 2 | — | — | BPS-MAE | — |

TABLE 2

| | Developed | | | | Printed | Adhesion | | Blocking resistance | |
|---|---|---|---|---|---|---|---|---|---|
| | color intensity | Water resistance | Photo resistance | Prevention of desensitization | image retention | immeidiately after bonding | 24 hours later | 40° C. 80% RH | 50° C. 80% RH |
| Example 1 | 1.35 | Good | Good | Good | Good | Good | Good | Good | Good |
| Example 2 | 1.20 | Good | Good | Good | Good | Good | Good | Good | Good |
| Example 3 | 1.40 | Good | Good | Good | Good | Good | Good | Good | Good |
| Example 4 | 1.35 | Good | Good | Good | Good | Good | Good | Good | Poor |
| Example 5 | 1.35 | Good | Good | Good | Good | Good | Good | Good | Fair |
| Example 6 | 1.40 | Good | Good | Fair | Fair | Good | Good | Good | Good |
| Example 7 | 0.41 | Good | Good | Fair | Fair | Good | Good | — | — |
| Example 8 | 1.10 | Good | Good | Excellent | Excellent | Good | Good | Good | Good |
| Example 9 | 1.10 | Good | Good | Excellent | Excellent | Good | Good | Good | Good |
| Example 10 | 1.06 | Good | Good | Excellent | Excellent | Good | Good | Good | Good |
| Example 11 | 1.10 | Good | Good | Excellent | Excellent | Good | Good | Good | Good |
| Comp. Example 1 | 1.65 | Poor | Poor | Excellent | Excellent | Good | Good | Good | Good |
| Comp. Example 2 | 1.50 | Poor | Poor | Excellent | Excellent | Good | Good | Good | Good |

It is concluded that the thermosensitive recording labels with the compositions of Examples 1 to 7 are excellent compositions for thermosensitive recording labels, since developed color intensity is lower compared to the thermosensitive recording labels with the compositions of Comparative Examples 1 and 2 but did not present practical problems, and, on the other hand, the thermosensitive recording labels with the compositions of Examples 1 to 7 had far better photo and water resistance.

The thermosensitive recording labels of the compositions in Examples 1 to 5 obtained using specific color developing agents exhibited inferior developed color intensity compared to the thermosensitive recording label (Example 6) obtained using other color developing agent, but presented no practical problems. In addition, the prevention of desensitization and printed image retention were excellent, time dependent declines in the color developing capability decreased and the influence of heating a tackifier to achieve tackiness on a thermosensitive recording layer decreased.

The thermosensitive recording labels of the compositions in Examples 8 to 11 with an intermediate layer have superior prevention of desensitization and printed image retention compared to the thermosensitive recording label of the compositions in Examples 1 to 7 without intermediate layer. Especially the thermosensitive recording labels of the compositions in Examples 10 using specific binder or crosslinker in the intermediate layer shows superior prevention of desensitization and printed image retention, and shows best balance among developed color intensity, prevention of desensitization, printed image retention, adhesion, blocking resistance and the like.

What is claimed is:

1. A thermosensitive recording label having a thermosensitive recording layer comprising a colorless or pale colored electron donating leuco dye and an electron accepting color developing agent on a transparent film substrate and a tackifier layer containing a tackifier on the thermosensitive recording layer, wherein the tackifier is not tacky at ambient temperature, an intermediate layer is installed between the thermosensitive recording layer and the tackifier layer, and the intermediate layer comprises (a) a resin containing a carboxyl group, (b) an epichlorohydrin type resin, and (c) a polyamine/amide resin.

2. The thermosensitive recording label of claim 1, wherein the lowest temperature at which the tackifier develops tackiness is between 40° C. and 100° C. when the tackifier is kept at the temperature in a forced air drier for 2 minutes.

3. The thermosensitive recording label of claim 1, wherein the intermediate layer further comprises a pigment and a binder.

4. The thermosensitive recording label of claim 1, wherein the polyamine/amide resin is one selected from the group consisting of polyamide urea resins, polyalkylene polyamine resins, polyalkylene polyamide resins, polyamine polyurea resins, modified polyamine resins, modified polyamide resins, polyalkylene polyamine urea formalin resins, and polyalkylene polyamine polyamide polyurea resins.

5. The thermosensitive recording label of claim 1, wherein the resin containing a carboxyl group is a carboxy modified polyvinylalcohol.

6. The thermosensitive recording label of claim 1, wherein the concentration of the epichlorohydrin resin and the polyamine/amide resin are independently from 1 to 100 weight parts per 100 weight parts of the resin containing a carboxyl group.

7. The thermosensitive recording label of claim 1, wherein the electron accepting color developing agent is a diphenyl sulfone cross-link type compound represented by the following formula (formula 1)

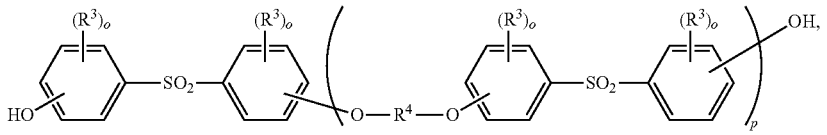

wherein $R^3$ independently represents a hydrogen atom, a halogen atom, an alkyl group having 1 to 6 carbon atoms or an alkenyl group having 1 to 6 carbon atoms, o independently represents an integer of from 0 to 4, p is an integer of from 1 to 11, and $R^4$ independently is (i) a hydrocarbon group having 1 to 12 carbon atoms, which may have an ether bond, which may be saturated or unsaturated, which may be linear or branched, (ii) a substituted phenylene group represented by a general formula below:

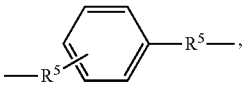

wherein $R^5$ represents a methylene group or ethylene group, or (iii) a divalent group represented by a general formula below:

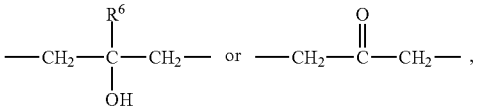

wherein $R^6$ represents a hydrogen atom or an alkyl group having 1 to 4 carbon atoms.

8. The thermosensitive recording label of claim 1, wherein the electron accepting color developing agent is a urea-urethane compound represented by the following formula (formula 5)

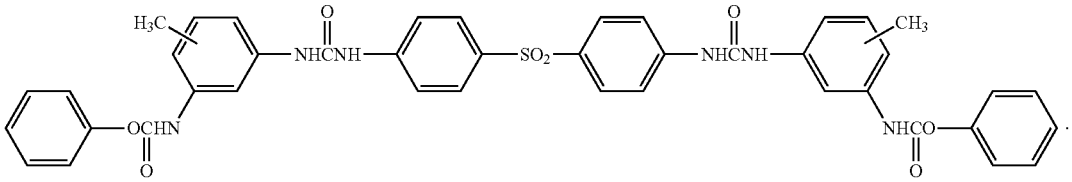

9. The thermosensitive recording label of claim 4, wherein the resin containing a carboxyl group is a carboxy modified polyvinylalcohol.

* * * * *